US005772505A

United States Patent [19]

Garczynski et al.

[11] Patent Number: 5,772,505

[45] Date of Patent: Jun. 30, 1998

[54] DUAL CARD SCANNER APPARATUS AND METHOD

[75] Inventors: John S. Garczynski, Norristown; John J. Dobson, Oreland, both of Pa.

[73] Assignee: Peripheral Dynamics, Inc., Plymouth Meeting, Pa.

[21] Appl. No.: 831,189

[22] Filed: Apr. 2, 1997

Related U.S. Application Data

[63] Continuation-in-part of Ser. No. 496,355, Jun. 29, 1995, Pat. No. 5,632,483.

[51] Int. Cl.[6] ..... A63F 1/06

[52] U.S. Cl. ..... 463/12; 463/29; 273/148 R; 273/309

[58] Field of Search ..... 463/29, 25, 12, 463/46; 273/148 R, 309, 292, 149 P

[56] References Cited

U.S. PATENT DOCUMENTS

| | | | |
|---|---|---|---|
| 3,397,133 | 8/1968 | Penzias | 273/149 P |
| 4,531,187 | 7/1985 | Uhland | 364/412 |
| 4,822,050 | 4/1989 | Normand et al. | 273/149 P |
| 5,039,102 | 8/1991 | Miller | 273/148 R |
| 5,110,134 | 5/1992 | Laughlin et al. | 273/293 |
| 5,219,172 | 6/1993 | Laughlin et al. | 273/304 |
| 5,224,712 | 7/1993 | Laughlin et al. | 273/304 |
| 5,312,104 | 5/1994 | Miller | 273/148 R |
| 5,431,399 | 7/1995 | Kelley | 273/149 P |
| 5,451,054 | 9/1995 | Orenstein | 273/309 |

*Primary Examiner*—Benjamin H. Layno
*Attorney, Agent, or Firm*—Woodcock Washburn Kurtz Mackiewicz & Norris LLP

[57] ABSTRACT

A dual card scanning module announces when the symbols of a face-up standard playing card and a face-down standard playing card achieve a desired combination. The module has a scanner system that illuminates and scans at least a portion of a symbol of the face-up standard playing card and at least a portion of a symbol of the face-down standard playing card and stores the results thereof in a first and second array device, respectively. The module also has a guide to assist in receiving and positioning the cards such that the face-up standard playing card is above and aligned with the face-down standard playing card. When in this position, the symbol portions of the face-up and the face-down standard playing cards can be scanned by the array devices to generate respective scanning results. The module compares the scanning results with a memory storing a plurality of references representing respective symbols of the standard playing cards to determine if the cards have achieved the desired combination.

23 Claims, 6 Drawing Sheets

DUAL CARD SCANNER APPARATUS AND METHOD

CROSS-REFERENCES TO RELATED APPLICATIONS

This application is a continuation-in-part of the application entitled "Blackjack Scanner Apparatus and Method", Ser. No. 08/496,355 filed on Jun. 29, 1995, now U.S. Pat. No. 5,632,483, which is incorporated herein by reference in its entirety.

BACKGROUND OF THE INVENTION

1. Field of the Invention

The present invention relates to card scanners, and more particularly, to a card scanner that scans two standard playing cards.

2. Description of the Prior Art

Blackjack is a card game often played in casinos. The game is played by a dealer dealing a hand of two cards face-up to every player and one card face-up and one card face-down to himself or herself. Each card has an associated value identified by the symbols on the card face, the symbols being characters or patterns. A card with a numerical character has a value equal to that of the number on the card. A card with a "J," "Q," or "K" character has a value of ten. A card with an "A" character has a value of one or eleven (for the purposes of the invention, "A" cards have a value of eleven). If the value of the dealer's hand totals twenty-one with his first two cards, he has "blackjack" and wins. Another way to express it is if the dealer's hand is an Ace and either a 10, Jack, Queen, or King, the dealer has blackjack. Traditionally, the dealer determines the value of the down-card by "peeking" at it. If the dealer does not have "blackjack," the game continues. If the dealer has "blackjack" he or she wins and the other players do not play out their hands and a new game can start immediately.

To insure against security breaches and resulting loss of revenue, casinos instituted a "no peek" rule that prevents dealers from peeking at their down-card. An unscrupulous dealer can peek at the down-card to provide an accomplice with the value of the dealer's cards. With that knowledge, the accomplice makes a more informed gambling decision when playing out his or her hand. This informed gambling decision significantly tilts the odds of winning away from the casino. With the odds tilted away from the casino, the casino loses potential revenue.

The blackjack game is significantly slowed by the "no peek" rule, which costs the casino revenue. The more games of blackjack played, the more potential revenue for the casino. With the "no peek" rule, every player in every game plays out his or her hand. Obviously, this is true for when the dealer is dealt "blackjack" initially. Therefore, when the dealer does get "blackjack" initially, the game continues longer than necessary, lowering the number of games of blackjack played at a table. Since a casino's revenue is directly proportional to the number of games of blackjack played, casinos lose potential revenue when less games are played.

Since certain casinos established the "no peek" rule more than a decade ago, they have been searching for a way for a dealer to know if he or she is initially dealt "blackjack" without breaching security. One possible avenue identified is a device that notifies the dealer when he or she has "blackjack" without the dealer lifting any part of the down-card off the surface of the blackjack table. The prior art discloses numerous apparatuses and methods to achieve the desired target. Unfortunately, each disclosure in the prior art leaves unaddressed certain concerns of the casinos.

The prior art teaches using marked cards and a mark sensor mounted in the surface of the playing table. As disclosed in U.S. Pat. Nos. 5,110,134 5,219,172, and 5,224,712 to Laughlin et al., the dealer slides the face-down card onto the sensor without lifting any portion of the card. However, this route is only partially successful because standard blackjack cards can not be used. This invention requires the cards to be specially marked with either a photoelectrically detectable mark, a magnetic mark, a light-polarizing mark, or something similar. The required use of specially marked cards instead of standard playing cards compels further development of a more acceptable solution.

U.S. Pat. No. 5,312,104 to Miller discloses the use of a bar code reader and bar-code-marked cards. As this design requires marked cards, it leaves unaddressed the same concerns as the Laughlin patents.

U.S. Pat. No. 5,039,102 to Miller discloses using a mirror arranged such that the dealer can view a reflected image of a portion of the face of the down-card. The dealer slides the down-card over a first viewport in the surface of the table. A mirror mounted under the first viewport reflects the down-card's image up through a second viewport in the table. This image is visible only to the dealer. Again, this patent specifically discloses the use of marked cards, still leaving some casino's concerns unaddressed. A further limitation of this disclosure is that the dealer has to be within a certain height range to view the card image through the second viewport.

One attempt to use standardized blackjack cards did not stand up to the rigors of the casino environment. This attempt utilized an optical reader that looked at eight points on a standard "Bee" brand playing card. The point locations were such that theoretically the playing cards could be identified just from comparing these eight points. However, due to dust and lint on the cards and changes in room temperature, this attempt resulted in a device that required excessive adjustments and calibrations. These restrictions limited the usefulness of this approach.

Another attempt to use standard blackjack cards involved the use of a video camera and screen. However, the costs involved with this type of equipment makes this approach expensive. Further, since the dealer would know the value of the card, security against unethical dealers is a problem also. The security aspect could be alleviated to a certain extent by using marked cards, as disclosed in U.S. Pat. No. 5,312,104 to Miller, but then the concerns of using marked cards surfaces.

It is clear that there has existed a long and unfilled need in the prior art for a device to reliably announce if a blackjack dealer is initially dealt "blackjack" without the dealer knowing the value of his or her down-card, without the use of a specially marked deck of cards, and in an economically viable way.

SUMMARY OF THE INVENTION

In order to achieve the advantages of the invention, there is provided a dual card scanning module for announcing when the symbols of a face-up standard playing card and a face-down standard playing card achieve a desired combination. The module has a scanner system that illuminates and scans at least a portion of a symbol of the face-up standard playing card and at least a portion of a symbol of the face-down standard playing card and stores the results thereof in a first and second array device, respectively. The module also has a guide to assist in receiving and positioning the cards such that the face-up standard playing card is above and aligned with the face-down standard playing card. When in this position, the symbol portions of the face-up and the face-down standard playing cards can be scanned by the array devices to generate respective scanning results. The module compares the scanning results with a memory storing a plurality of references representing respective symbols of the standard playing cards to determine if the cards have achieved the desired combination.

DETAILED DESCRIPTION OF THE PREFERRED EMBODIMENT(S)

Figure 1:
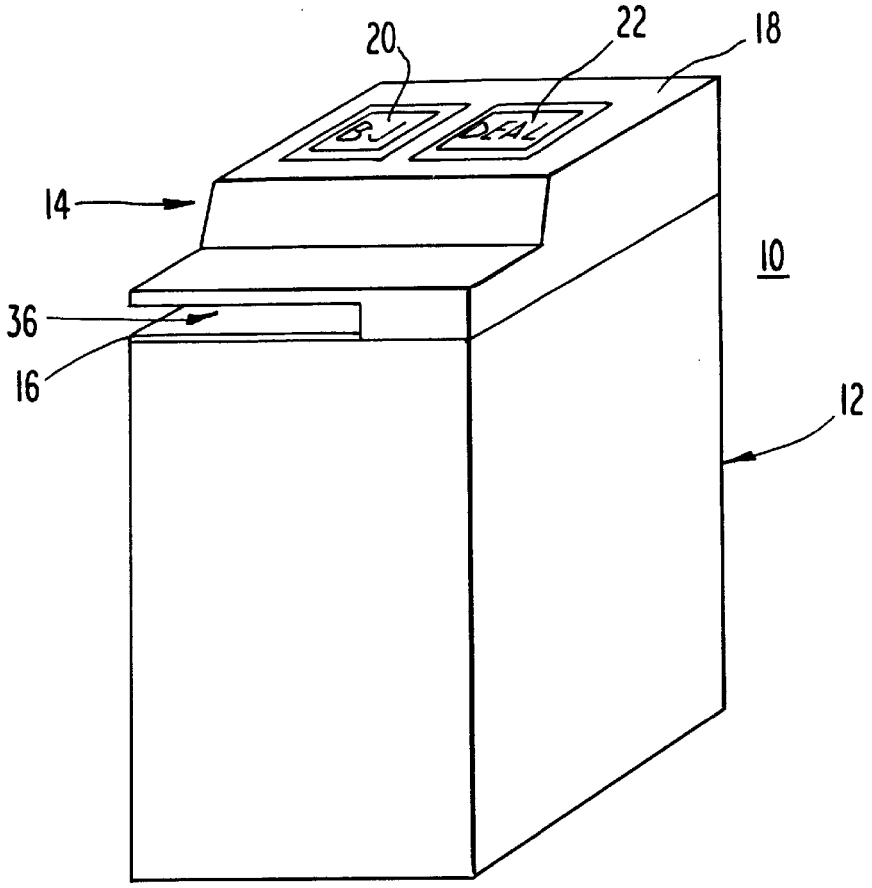
FIG. 1 shows an isometric view of a dual card scanning module according to the present invention.
Figure 2:
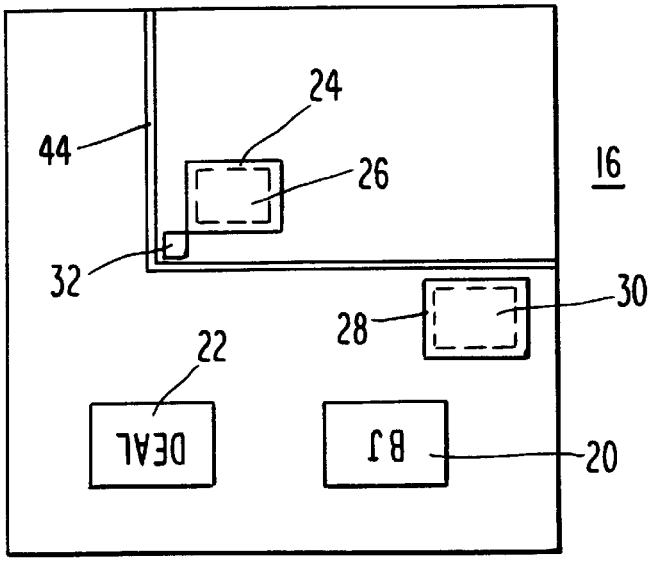
FIG. 2 shows a top view of the module without the shield.
Figure 3:
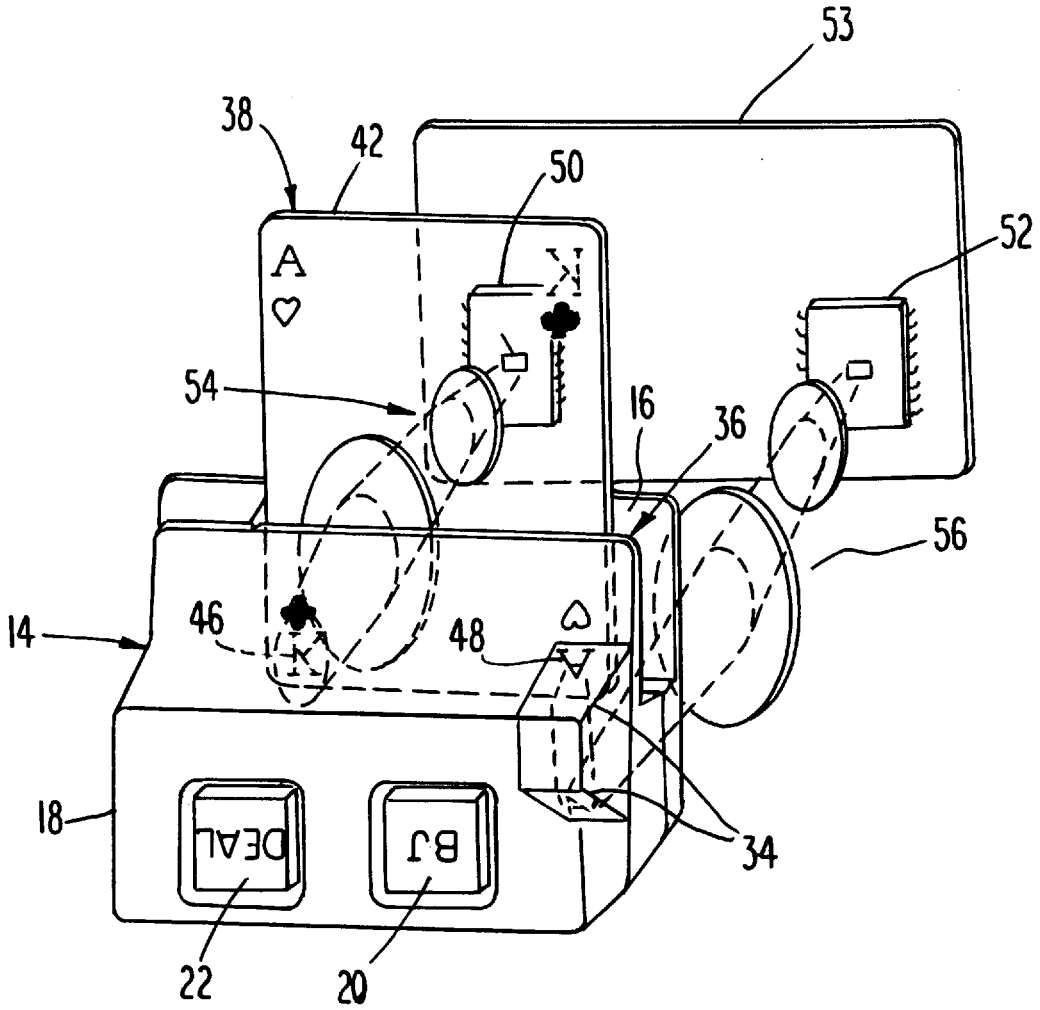
FIG. 3 shows a schematic, isometric view of images of the symbols from the card hand being projected onto array chips in the module.

Referring now to the drawings, wherein like reference numerals refer to like elements throughout, and specifically referring to FIGS. 1, 2, and 3, a housing and a top plate assembly of a dual scanning module 10 is shown. The housing 12 is a rectangular, hollow block or can with an open top side that is covered by the top plate assembly 14. When in use, a card hand 38 of two standard playing cards 40 and 42 is placed in a slot 36 of the top plate assembly 14 (see FIG. 3) and a "BJ" light 20 in the top plate assembly lights up if the hand is blackjack. In the alternative, a "DEAL" light 22 in the top plate assembly 14 lights up when the hand is not blackjack. The dual scanning module 10 determines if the card hand 38 is blackjack by scanning and analyzing a least a portion of a symbol from the face of both cards in the hand.

The top plate assembly 14 is comprised of a base 16, a shield 18, the "BJ" switch 20, the "DEAL" switch 22, glass cover plates 24 and 28 covering holes 26 and 30 respectively, a microswitch 32, and a set of mirrors 34. The base 16 and the shield 18 are arranged to form the slot 36 into which is inserted a portion of the card hand 38 to be scanned. The base 16 has a ridge 44 that vertically extends therefrom and assists in guiding the card hand 38 into a proper scanning position. The ridge 44 meets with the shield 18 to form a dust barrier.

The card hand 38 has a face-up card 40 and a face-down card 42, which are the ace of hearts and the king of clubs in FIG. 3, respectively. The card hand 38 is positioned in the slot 36 such that the cards 40 and 42 are aligned with the face-up card 40 facing up, or toward, the shield 18 and the face-down card 42 is below the face-up card and facing down, or toward, the base 16. When properly positioned, the card hand 38 manipulates the microswitch 32 to indicate that the hand is in the slot 36. Other embodiments of the invention may have the card hand 38 actuating other suitable and equivalent means when properly positioned, such as a photosensor.

When the card hand 38 is positioned in the slot 36, the images of a symbol 46 of the face-down card 42 and a symbol 48 of the face-up card 40, being "K" and "A" respectively, are projected through the base 16 and into the housing 12. The "K" symbol 46 is positioned above the hole 26 so that the symbol image is directly projected through the hole and into the housing 12. However, as the "A" symbol 48 faces away from the housing 12, the symbol cannot be directly projected therein. In the embodiment of the invention shown, a set of mirrors 34 are positioned in the underside of the shield 18 to indirectly project the "A" image past the guide 44 and down through hole 28, which is not in the slot 36. Other embodiments of the invention may use other suitable equivalent systems to indirectly project the image of the face-up card 40 symbol into the housing 12, including prisms and fiber optics. The holes 26 and 30 are essentially rectangular in shape and sized to accommodate scanning the symbols 46 and 48 that appear in the corner of a standard playing card. The symbols may be 2, 3, 4, 5, 6, 7, 8, 9, 10, J, Q, K, and A. Other embodiments of the invention may scan a portion of the symbol or at least a portion of the design in the center of the face of a standard playing card. It is understood that standard playing cards are commercially available and without any special or extra markings that identify the playing card.

The dual scanning module 10 scans the symbols 46 and 48 by projecting the images thereof onto a first array chip 50 and a second array chip 52, respectively, located in the housing 12. In the embodiment of FIG. 3, the images are projected onto the array chips 50 and 52 using lens sets 54 and 56 respectively. The array chips 50 and 52 are mounted on an array chip circuit board 53. Other embodiments of the invention may use other suitable means for projecting the images onto the array chips.

Figure 4:
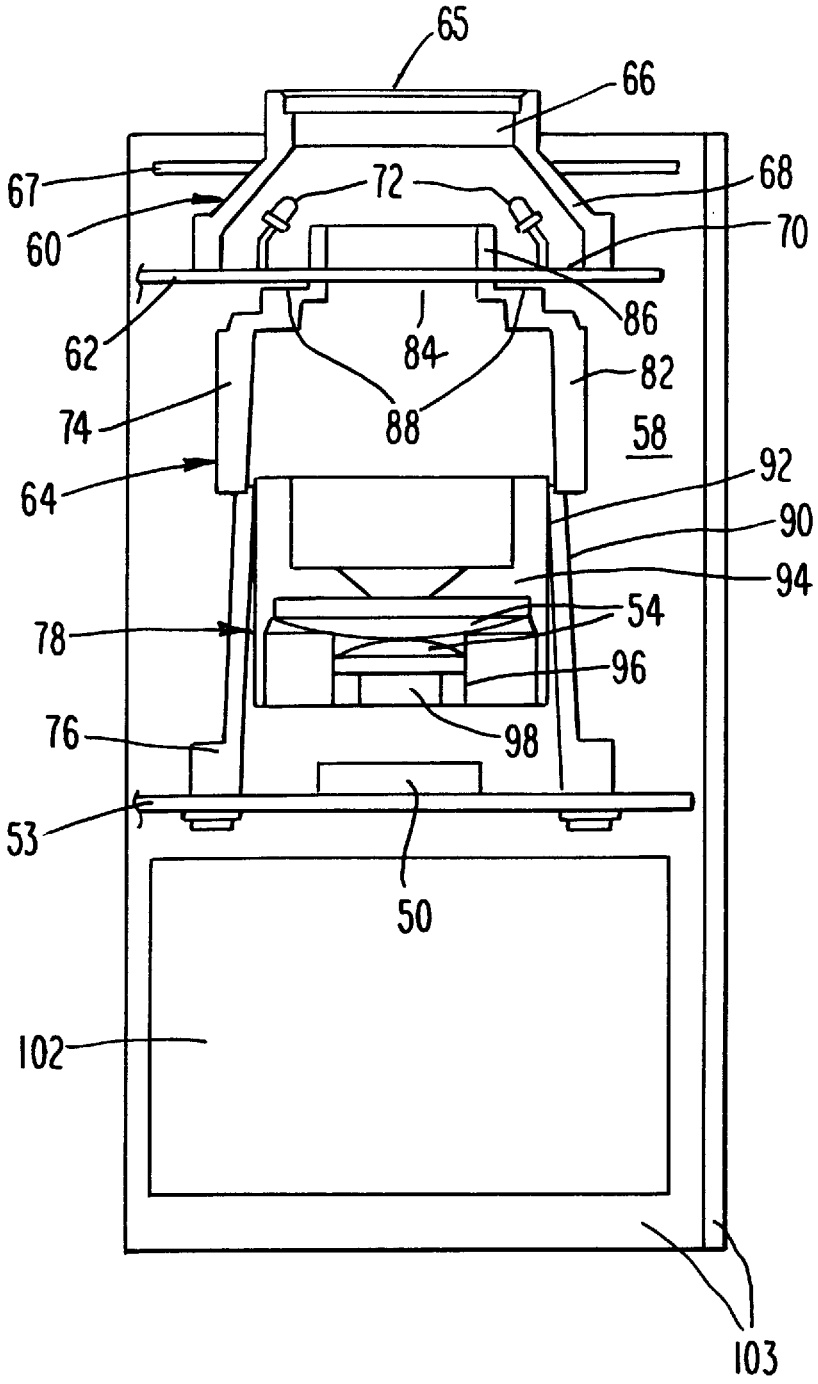
FIG. 4 shows a lens set assembly, battery, and processing/memory circuit boards of the module.

Now referring to FIG. 4, the lens set 54 is mounted in a lens set assembly 58 that not only positions the lenses relative to the array chip 50, but provides illumination for projecting the image as well. The lens assembly 58 is mounted inside the housing 12, along with an internal battery 102 and processing/memory storage circuit boards 103

When installed in the housing 12, the lens set assembly 58 is located beneath the hole 26. A similar lens set assembly is located beneath the hole 30. The assembly 58 is comprised of a top housing 60, an LED circuit board 62, a lens housing 64, and an array chip circuit board 53. The components of lens set assembly 58 are arranged such that the top housing 60 is adjacent to the hole 26 with the LED circuit board 62, the lens housing 64, and the array chip circuit board 53 are located therebelow, respectively. These components are assembled to inhibit dust from entering into the lens set assembly 58.

The top housing 60 is a hollow, vertical sleeve with a top opening 65, a top section 66, an expansion section 68, and a bottom opening 70. The top opening 65 is sized to accommodate the hole 26. Top section 66 of top housing 60 extends down from base 16 and through a light circuit board 67 when installed. The "BJ" and "DEAL" lights 20 and 22 are mounted on the light circuit board 67 and extend through the shield 18 (not shown). Expansion section 68 is located adjacent to and below the light circuit board 67.

Circuit board 62 is horizontally positioned adjacent to the top housing 60 and abuts its bottom opening 70. Four LEDs 72 (only two are visible) are mounted to the top of LED circuit board 62 and are located inside the expansion section 68. LEDs 72 are the light source used to illuminate the symbol being scanned. Other embodiments of the invention may have more or less LEDs or other sources of light. LEDs 72 are positioned such that they do not block passage of light to the array chip 50 receiving the symbol image.

The lens housing 64 is located below LED circuit board 62 and has an upper sleeve section 74, a lower sleeve section 76, a lens barrel 78, and the lens set 54. Upper sleeve section 74 and lower sleeve section 76 are vertically aligned such that each section's main axis is not only concurrent with each other, but with the main axis of top section 60 as well. Upper sleeve section 74 is a substantially square sleeve with a vertical wall 82 and a narrow top opening 84. A rim 86 extends up from narrow top opening 84. A top surface 88 approximately radially extends from the narrow top opening 84 to vertical wall 82 of upper sleeve section 74. Upper sleeve section 74 is attached to the bottom of LED circuit board 62. Lower sleeve section 76's vertical wall 90 has substantially the same cross-sectional area perpendicular to the main axis as does upper sleeve 74. The bottom edge of vertical wall 90 abuts the upper edge of wall 82.

The lens barrel 78 is another sleeve shaped device which holds the lens set 54. It is slidable mounted inside the upper and lower sleeve sections 74 and 76. Lens barrel 78 is comprised of a barrel 92 with an internal latitudinal ridge 94, and a plug 96. The lens set 54 resides in the barrel 92 and they are oriented perpendicular to the main axis of the upper and lower sleeve sections 74 and 76. The lens set 54 is maintained in a static position in the barrel 92 with an adhesive to secure one lens to the ridge 94 and the other lens to the plug 96. The plug 96 has a hole 98 bored through it, allowing the symbol 48 image to be projected onto the array chip 50. The lens barrel 78 is movably mounted within upper and lower sleeve sections 74 and 76 to also facilitate adjusting the focus of the image projected onto the array chip 50.

The array chip circuit board 53 is attached to the bottom edge of the lower sleeve 76 in a horizontal position. The array chip 50 is mounted on the top surface of array chip circuit board 53 and is located within the lower sleeve section 76. The array chip 50 in the instant embodiment is comprised of a 14 by 41 array, however, other embodiments of the invention may use other array chips.

In the preferred embodiment of the invention, an internal battery 102 is located below the lens set assembly in the housing 12 and supplies power to operate the dual scanning module. Power is supplied when the card hand 38 actuates the microswitch 32, thus conserving the battery when the module is not in use. Other embodiments of the invention may use external batteries or another power source. Also, processing and memory circuit boards 103 may be also be installed in the housing or external to the housing.

Figure 5:
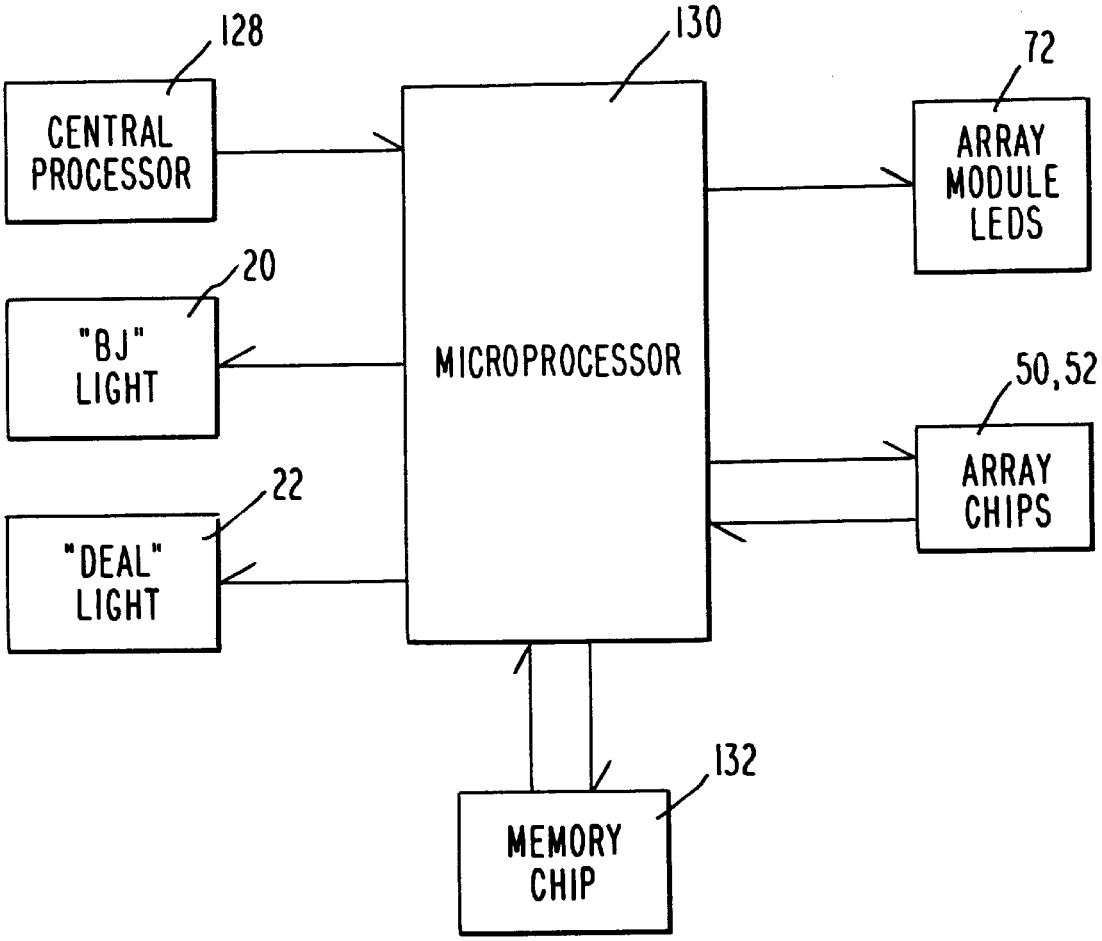
FIG. 5 shows a schematic of the components of the module which interact with the microprocessor.

FIG. 5 illustrates a simplified schematic of the components of the dual scanning module 10 that interact with a microprocessor chip 130 for the module 10 to perform its intended function. In the preferred embodiment of the invention, the microprocessor chip 130 is located on the processing/memory circuit boards 103 located in the housing 12. The microprocessor chip 130 receives input from and sends output to the array chips 50 and 52 and a memory storage chip 132 that is preferable mounted on a memory circuit board that it internal to the housing 12. The memory storage chip 132 stores the references used to determine the symbols scanned by the module 10. The microprocessor 130 provides output to the "BJ" and "DEAL" lights 20 and 22 and the LEDs 72. The microprocessor also provides output to a central processor 128 which record the activities of the module 10. Other embodiments of the invention may not have the microprocessor 130 transmitting to a central processor.

Figure 6:
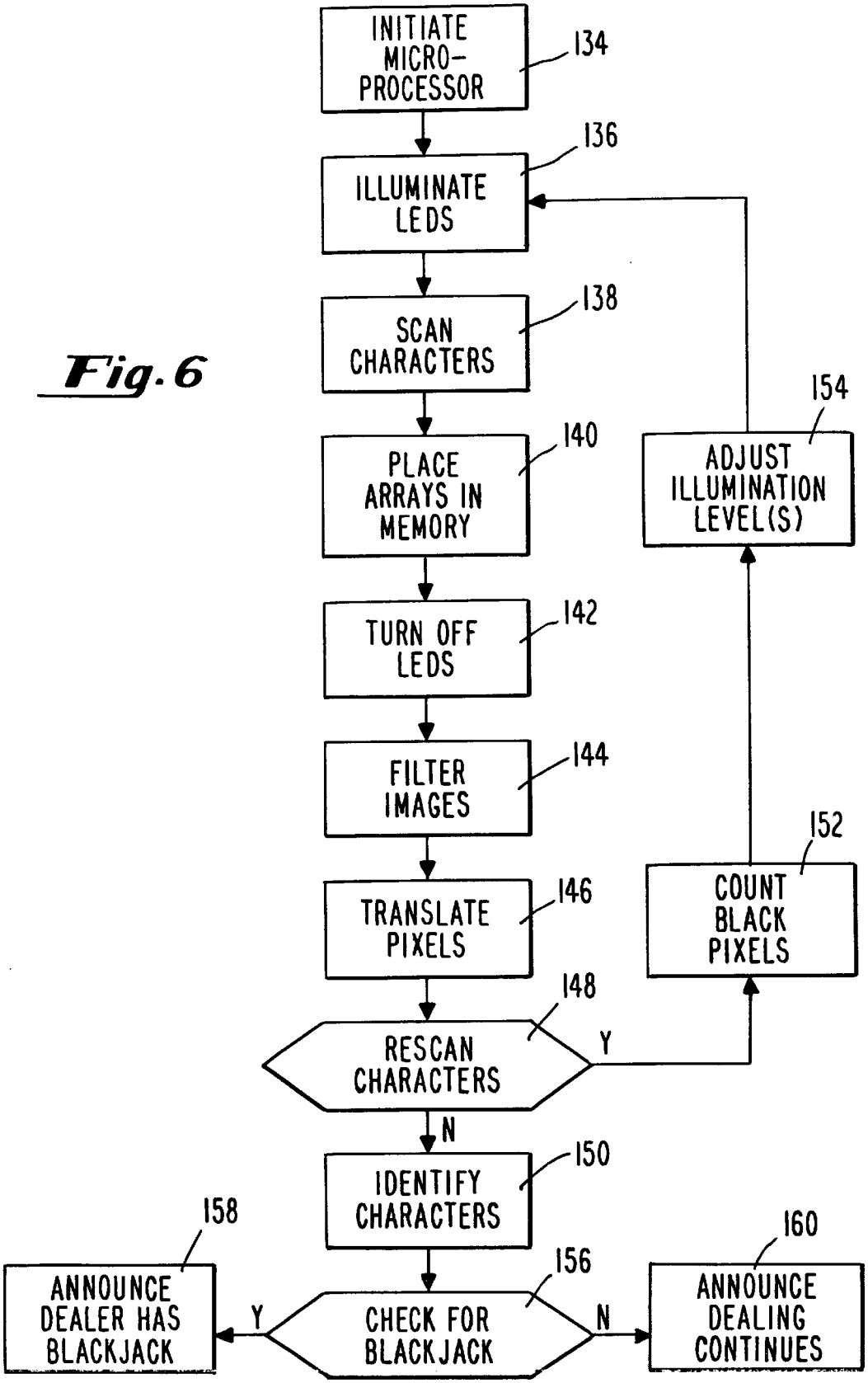
FIG. 6 shows a flow chart of the steps of scanning, analyzing, and announcing the results of scanning the card hand.

FIG. 6 illustrates the simplified routine the microprocessor 130 carries out for analyzing the symbols and announcing the result. In block 134, microprocessor 130 is initiated by the card hand 38 actuating the microswitch 32. In other embodiments of the invention, microprocessor 130 may be initiated by foot pedals or other switch external to housing 12, verbal recognition, visual identification by a device, and more. The routine progresses to block 136 and illuminates LEDs 72 so symbols 46 and 48 can be scanned.

Next, the routine progresses to block 138 and the first and second array chips 50 and 52 scan the symbols 46 and 48, respectively. In the preferred embodiment, the dual scanning module 10 is configured and arranged to scan the entire symbol representing the value of a card, the possible symbols being 2, 3, 4, 5, 6, 7, 8, 9, 10, J, Q, K, and A. However, other embodiments of the invention may scan only a portion of the symbol or scan the middle area of the face of a standard playing card.

In the preferred embodiment, the array chip translates the image of the symbol on a card into black and white values, or pixels, that are collectively known as scan data. Other embodiments of the invention include utilizing an array chip that translates the image of a character on a card into color values. The routine progresses to block 140 and microprocessor 130 retrieves scan data from the array chips 50 and 52 and translates it into memory in the form of stored pixel images. Next, the routine progresses to block 142 and turns off LEDs 72.

Next, the routine removes noise from the stored pixel images to counteract errors from heat, dust, ashes and lint from a casino-like environment. In block 144, the noise is reduced by filtering the stored pixel images with a pixel mask. In an embodiment of the invention, the filtering may be accomplished by removing the non-contiguous black pixels from each stored pixel image. In an alternative embodiment of the invention, the routine enlarges the stored pixel images by providing a respective image with an additional top and bottom row and a far right and far left column. Then the routine filters the enlarged pixel images with a "3×3" pixel mask. The filtering is accomplished by placing the mask over the nine pixels in the upper left corner of the enlarged pixel image and counting the number of black pixels covered by the mask. If the number of black pixels is less than three, then the array element corresponding to the pixel in the center of the mask is assigned to be white. If the number of black pixels is greater than seven, then the array element corresponding to the pixel in the center of the mask is assigned to be black. This process continues through the array until the pixel mask has assigned black or white to every possible element in the array. The outer rows and columns drop out of the array as they cannot be assigned a value by the pixel mask, returning the array to its original size. This block performs the process on both arrays.

Next, the routine progresses to block 146 and the black pixels of the stored pixel images are translated to the upper left corner of the arrays while maintaining the relative positions of the black pixels in relation to each other. This translation is accomplished by shifting the field of each array one row up and/or one column to the left until the top row has any black pixels and the left column has at least two black pixels. Next, at block 148, the routine determines whether the stored pixel images can be identified or if either or both of the symbols needs to be re-scanned. If the number of white and black pixels are such that both symbols can be identified, then the routine progresses to block 150 and the symbols are identified.

If the routine cannot identify either of the symbols, the routine branches to blocks 152 and 154 that facilitate optimizing the level of illumination of the unidentified symbol. Block 152 counts the black pixels of the stored pixel images. If the number of black pixels is such that there are too many black pixels or too few black pixels in the stored pixel image to match any reference character in memory chip 132, the routine branches to block 154 where the illumination of the symbol in question is adjusted. If there are too many black pixels, the intensity of the light emitted by LEDs 72 is increased. If there are too few black pixels, the intensity of the light emitted by LEDs 72 is decreased. The routine then branches to block 136 to illuminate the symbol in question and re-scan it. In the preferred embodiment of the invention, only the too "black" or too "white" stored pixel images may be rescanned and the routine attempts to optimize the illumination twice. If after two attempts the character cannot be identified, the routine terminates (not shown). In the preferred embodiment of the invention, the "BJ" and "DEAL" lights alternating blink for a period of time when the routine terminates under this circumstance.

From block 150, the routine proceeds to block 156 and microprocessor 130 analyzes if the dealer has blackjack based on the symbols it has identified. If the card hand is blackjack, the routine branches to block 158 and the module announces it by lighting the "BJ" light 20 in the depicted embodiment. However, if card hand 38 is not blackjack, then the routine proceeds to block 160 and the module announces that the deal continues. In the preferred embodiment, block 160 is accomplished by lighting the "DEAL" light 22. However, either or both announcing steps 158 and 160 can be accomplished by an audio announcement, a combined audio and visual announcement or other type of results annunciation, or by an electronic signal, to name a few other equivalent ways to announce the result. Further, the result may be transmitted to the central processor 128.

As is evident, some excitement among the players of blackjack can be generated using dual scanning module 10. The players can see the dealer insert the cards into the module, encouraging more player interaction by allowing the players to anticipate and root for "DEAL" light 22 to be illuminated, signaling that the players still have a chance to win.

Preferably, a single type of casino grade playing cards should be used when using scanning module 10.

Figure 7:
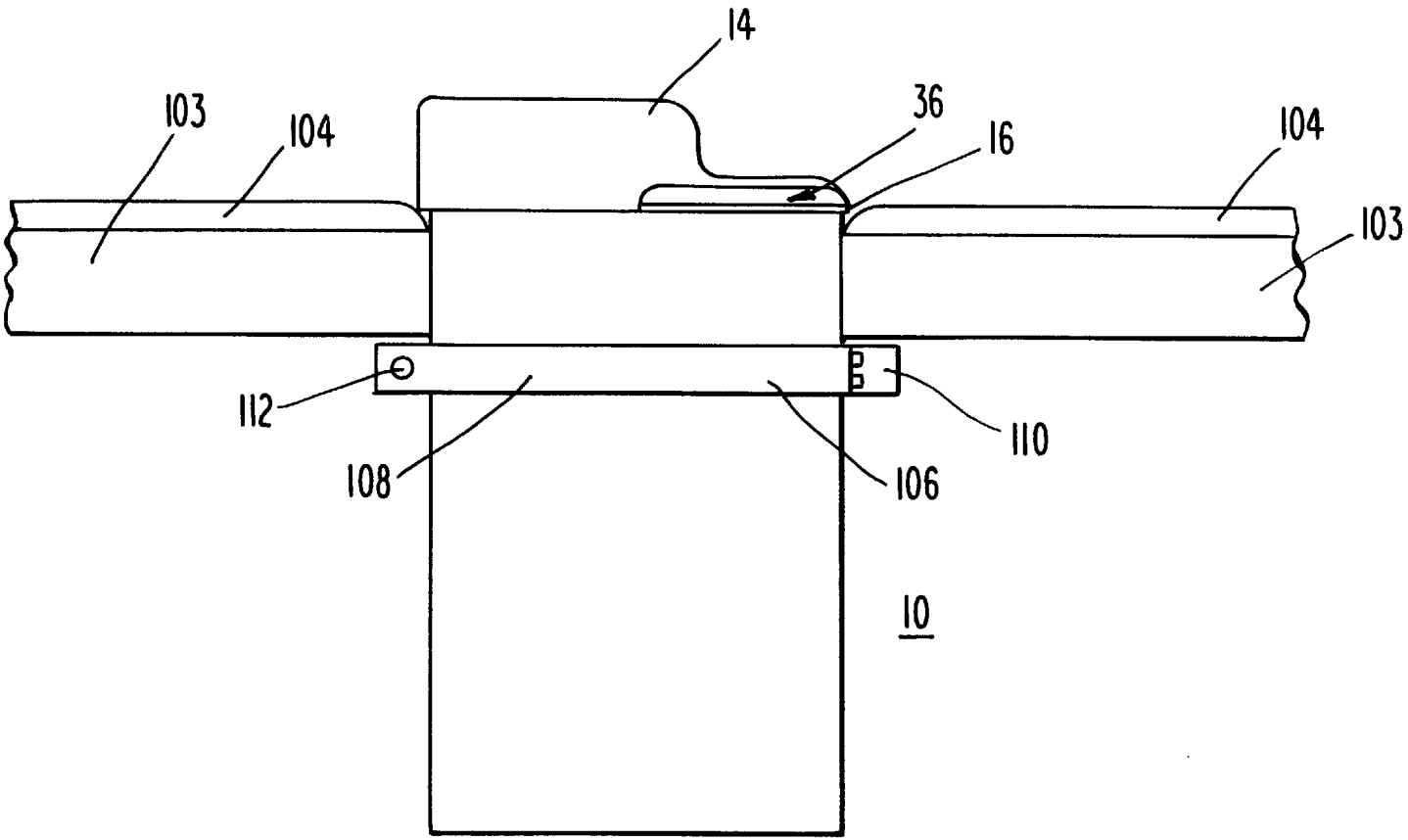
FIG. 7 shows a side view of the module mounted in a table top.

FIG. 7 shows the dual scanning module 10 mounted to blackjack table 103 with a felt surface 104. The top plate assembly 14 is positioned in felt surface 104 to allow a dealer to slide the card hand across the felt surface 104 and into card insertion slot 36 of top plate assembly 14. Since the card hand 36 slid into slot 36 with the face-down card 42 remaining face-down, the dealer cannot read the value of the face-down card 42. By the dealer not reading the face-down card 42, the opportunity for cheating the casino is decreased as described above. The housing 12 extends through and below blackjack table 103. A mounting bracket 106, basically comprised of 2 metal straps 108 (only one is visible) attached by hinge 110, is mounted to the underside of blackjack table 103. The metal straps 108 are designed and arranged to grasp the housing 16 by tightening of thumb screw 112 which draws together the two ends of the metal straps 108 that are not hinged.

The present invention may be embodied in other specific forms without departing from the spirit or essential attributes thereof and, accordingly, reference should be made to the appended claims, rather than to the foregoing specification, as indicating the scope of the invention.

We claim:

1. A dual card scanning module for announcing when the symbols on a face-up standard playing card and a face-down standard playing card achieve a desired combination, said scanning module comprising:

a) a scanner for illuminating and scanning at least a portion of a symbol on the face-up standard playing card and at least a portion of a symbol on the face-down standard playing card and storing the scanning results thereof in first and second devices, respectively;

b) a guide for receiving and positioning the playing cards such that the face-up standard playing card is above and aligned with the face-down standard playing card, and said symbol portions are scannable by said scanner;

c) memory for storing a plurality of references representing respective symbols of the standard playing cards; and d) analyzing means for determining and reporting if the symbols comprise the desired combination based on a comparison of said scanning results and said references.

2. The module of claim 1, wherein said desired combination is blackjack.

3. The module of claim 1, wherein said analyzing means further comprises a filter for removing errors of the type generated by a casino-like atmosphere from said scanning results.

4. The module of claim 3, wherein said scanner further comprises one or more adjustable light sources for illuminating said symbol portions.

5. The module of claim 4, wherein said adjustable lights sources comprise LEDs.

6. The module of claim 4, wherein said analyzing means further comprises illumination optimizing means for directing said adjustable light sources to facilitate determining if the symbols comprise the desired combination.

7. The module of claim 1, wherein:

a) said first and second devices are disposed to approximately face the face-down standard playing card when the playing cards are received by said guide; and b) said scanner comprises face-up symbol projecting means for redirecting an image of said face-up standard playing card symbol portion to be incident on said second device.

8. The module of claim 7, wherein said face-up symbol projecting means comprises at least two reflective surfaces.

9. The module of claim 1, further comprising mounting means for mounting the module to a table.

10. The module of claim 1, wherein said analyzing means comprises a visual output device for announcing when the symbols comprise the desired combination.

11. The module of claim 1, wherein said analyzing means further comprises transmitting means for transmitting one or more signals representative of said comparison to a central processor.

12. The module of claim 1, wherein said guide comprises an actuation device that initiates scanning of the symbol portions after the playing cards have been received and positioned by said guide.

13. The module of claim 12, wherein said actuation device comprises a microswitch manipulable by at least one of the playing cards.

14. The module of claim 1, further comprising a battery for supplying power to the module.

15. A method for announcing when the symbols on a face-up standard playing card and a face-down standard playing card achieve a desired combination, comprising the steps of:

a) aligning the face-up standard playing card above the face-down standard playing card;

b) positioning at least a portion of said aligned standard playing cards in a card scanner comprising first and second devices;

c) retrieving a first scanning result of at least a portion of a symbol on the face-down standard playing card with said first device;

d) retrieving a second scanning result of at least a portion of a symbol on the face-up standard playing card with said second device;

e) determining the symbols of the face-down and face-up standard playing cards by comparing said first scanning result and said second scanning result to a plurality of reference representations; and f) announcing when the symbols comprise the desired combination based on said comparison.

16. The method of claim 15, wherein the announcing step further comprises the step of announcing when the symbols comprise blackjack based on said comparison.

17. The method of claim 15, wherein the announcing step further comprises the step of announcing when the symbols do not comprise blackjack based on said comparison.

18. The method of claim 15, further comprising the step of removing noise from said first and second scanning results, said noise resulting from a casino-like atmosphere.

19. The method of claim 15, further comprising the step of adjustably illuminating said symbol portions.

20. The method of claim 19, wherein the step of adjustably illuminating said symbol portions comprises adjusting the illumination of said symbol portions to a desired level.

21. The method of claim 15, wherein said positioning step further comprises the step of sliding said aligned standard playing cards across a table top and into said card scanner.

22. The method of claim 15, wherein said step of directing said second array device further comprises the step of redirecting an image of said face-up standard playing card symbol portion.

23. The method of claim 15, wherein said announcing step further comprises the step of transmitting one or more signals representative of said comparison to a central processor.

* * * * *